US012222104B2

(12) United States Patent
Giridharan et al.

(10) Patent No.: US 12,222,104 B2
(45) Date of Patent: Feb. 11, 2025

(54) TURBINE ENGINE COMBUSTOR AND COMBUSTOR LINER

(71) Applicant: General Electric Company, Schenectady, NY (US)

(72) Inventors: Manampathy G. Giridharan, Evendale, OH (US); Michael T. Bucaro, Arvada, CO (US); Pradeep Naik, Bengaluru (IN); Clayton S. Cooper, Evendale, OH (US); Michael A. Benjamin, Cincinnati, OH (US); Steven C. Vise, West Chester, OH (US); Ajoy Patra, Bengaluru (IN); Perumallu Vukanti, Bengaluru (IN); R Narasimha Chiranthan, Bengaluru (IN)

(73) Assignee: General Electric Company, Evendale, OH (US)

( * ) Notice: Subject to any disclaimer, the term of this patent is extended or adjusted under 35 U.S.C. 154(b) by 0 days.

(21) Appl. No.: 17/740,443

(22) Filed: May 10, 2022

(65) Prior Publication Data

US 2023/0296250 A1 Sep. 21, 2023

Related U.S. Application Data

(60) Provisional application No. 63/321,900, filed on Mar. 21, 2022.

(51) Int. Cl.

| | |
|---|---|
| ***F23R 3/00*** | (2006.01) |
| ***F23R 3/16*** | (2006.01) |
| ***F23R 3/26*** | (2006.01) |

(52) U.S. Cl.
CPC ..... *F23R 3/002* (2013.01); *F23R 3/16* (2013.01); *F23R 3/26* (2013.01); *F23R 2900/03044* (2013.01)

(58) Field of Classification Search
CPC .. F23R 3/002; F23R 2900/03044; F23R 3/06; F23R 3/16
See application file for complete search history.

(56) References Cited

U.S. PATENT DOCUMENTS

| | | | | |
|---|---|---|---|---|
| 2,531,810 A | | 11/1950 | Fyffe | |
| 2,595,999 A | | 5/1952 | Way et al. | |
| 2,916,878 A | | 12/1959 | Wirt | |
| 2,999,359 A | | 9/1961 | Murray | |
| 3,593,518 A | * | 7/1971 | Gerrard | F23R 3/06 60/39.23 |
| 3,656,297 A | * | 4/1972 | Monk | B25C 1/182 297/19 |
| 3,869,864 A | * | 3/1975 | Bunn | F23R 3/12 60/749 |

(Continued)

FOREIGN PATENT DOCUMENTS

| | | |
|---|---|---|
| EP | 2463582 B1 | 6/2019 |
| WO | 2004035992 A1 | 4/2004 |

*Primary Examiner* — Arun Goyal
*Assistant Examiner* — Henry Ng
(74) *Attorney, Agent, or Firm* — McGarry Bair PC

(57) ABSTRACT

A turbine engine can include a compressor section, a combustion section, and a turbine section in serial flow arrangement. A combustor in the combustion section can include a combustor liner at least partially defining a combustion chamber. The combustor liner can include at least one aperture fluidly coupled to the combustion chamber.

20 Claims, 8 Drawing Sheets

(56) References Cited

U.S. PATENT DOCUMENTS

| | | | | | |
|---|---|---|---|---|---|
| 4,051,670 | A * | 10/1977 | Pierce | F23R 3/16 | 60/761 |
| 4,205,524 | A * | 6/1980 | Schirmer | F23C 6/045 | 60/776 |
| 5,069,033 | A * | 12/1991 | Shekleton | F23R 3/42 | 60/737 |
| 6,845,621 | B2 * | 1/2005 | Teets | F02C 3/085 | 60/749 |
| 6,959,550 | B2 | 11/2005 | Freeman et al. | | |
| 9,765,968 | B2 | 9/2017 | Gage et al. | | |
| 10,533,746 | B2 | 1/2020 | Rimmer et al. | | |
| 10,767,512 | B2 | 9/2020 | Paillard et al. | | |
| 11,371,701 | B1 * | 6/2022 | Gandikota | F23R 3/002 | |
| 11,578,868 | B1 * | 2/2023 | Chakraborty | F23R 3/06 | |
| 2013/0078582 | A1 * | 3/2013 | Pidcock | F23R 3/06 | 431/12 |
| 2013/0255265 | A1 * | 10/2013 | Rudrapatna | F23R 3/16 | 29/889.22 |
| 2017/0176005 | A1 * | 6/2017 | Rimmer | F23R 3/002 | |
| 2017/0299182 | A1 * | 10/2017 | Miyauchi | F23R 3/46 | |
| 2018/0283689 | A1 * | 10/2018 | Wang | F23R 3/06 | |
| 2019/0113231 | A1 * | 4/2019 | Kajimura | F23R 3/50 | |
| 2021/0107897 | A1 * | 4/2021 | Chen | C07C 231/08 | |
| 2022/0364510 | A1 * | 11/2022 | Gandikota | F02C 7/22 | |
| 2022/0390110 | A1 * | 12/2022 | Naik | F23R 3/16 | |
| 2022/0390111 | A1 * | 12/2022 | Ganiger | F02C 7/18 | |
| 2022/0390112 | A1 * | 12/2022 | Ganiger | F23R 3/50 | |
| 2022/0390113 | A1 * | 12/2022 | Ganiger | F23R 3/40 | |
| 2023/0003382 | A1 * | 1/2023 | Ganiger | F23R 3/50 | |

* cited by examiner

TURBINE ENGINE COMBUSTOR AND COMBUSTOR LINER

CROSS-REFERENCE TO RELATED APPLICATION(S)

This application claims the benefit of U.S. Provisional Patent Application No. 63/321,900, filed Mar. 21, 2022, which is incorporated herein by reference in its entirety.

TECHNICAL FIELD

The present subject matter relates generally to a combustor, for a turbine engine, having a combustor liner, and more specifically to a combustor liner with dilution hole arrangements.

BACKGROUND

Turbine engines are driven by a flow of combustion gases passing through a turbine section of the turbine engine to rotate a multitude of turbine blades, which, in turn, rotate a multitude of compressor blades, which supply compressed air to the combustor for combustion. A combustor can be provided within the turbine engine and is fluidly coupled with a turbine into which the combusted gases flow.

In a typical turbine engine, air and fuel are supplied to a combustion chamber, mixed, and then ignited to produce hot gas. The hot gas is then fed to a turbine where it rotates a turbine to generate power.

DETAILED DESCRIPTION

Figure 1:
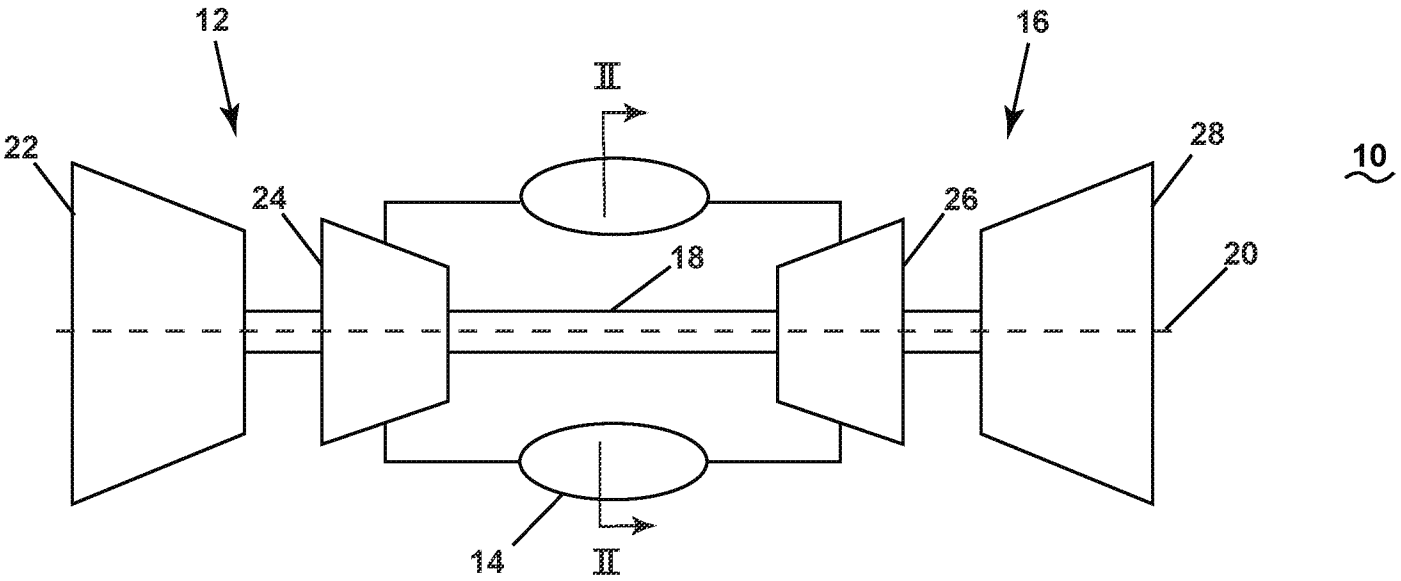
FIG. 1 is a schematic cross-sectional view of a turbine engine having a compression section, a combustion section, and a turbine section in accordance with various aspects described herein.

Aspects of the disclosure described herein are directed to a combustor with a combustor liner. For purposes of illustration, the present disclosure will be described with respect to a turbine engine. It will be understood, however, that aspects of the disclosure described herein are not so limited and that a combustor as described herein can be implemented in engines, including but not limited to turbojet, turboprop, turboshaft, and turbofan engines. Aspects of the disclosure discussed herein may have general applicability within non-aircraft engines having a combustor, such as other mobile applications and non-mobile industrial, commercial, and residential applications.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

As used herein, the terms "first", "second", and "third" may be used interchangeably to distinguish one component from another and are not intended to signify location or importance of the individual components.

The terms "forward" and "aft" refer to relative positions within a gas turbine engine or vehicle, and refer to the normal operational attitude of the gas turbine engine or vehicle. For example, with regard to a gas turbine engine, forward refers to a position closer to an engine inlet and aft refers to a position closer to an engine nozzle or exhaust.

As used herein, the term "upstream" refers to a direction that is opposite the fluid flow direction, and the term "downstream" refers to a direction that is in the same direction as the fluid flow. The term "fore" or "forward" means in front of something and "aft" or "rearward" means behind something. For example, when used in terms of fluid flow, fore/forward can mean upstream and aft/rearward can mean downstream.

The term "fluid" may be a gas or a liquid. The term "fluid communication" means that a fluid is capable of making the connection between the areas specified.

Additionally, as may be used herein, the terms "radial" or "radially" refer to a direction away from a common center. For example, in the overall context of a turbine engine, radial refers to a direction along a ray extending between a center longitudinal axis of the engine and an outer engine circumference.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, connected, and joined) are to be construed broadly and can include intermediate structural elements between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

The singular forms "a", "an", and "the" include plural references unless the context clearly dictates otherwise. Furthermore, as used herein, the term "set" or a "set" of elements can be any number of elements, including only one.

Approximating language, as used herein throughout the specification and claims, is applied to modify any quantitative representation that could permissibly vary without resulting in a change in the basic function to which it is related. Accordingly, a value modified by a term or terms, such as "about", "approximately", "generally", and "substantially", are not to be limited to the precise value specified. In at least some instances, the approximating language may correspond to the precision of an instrument for measuring the value, or the precision of the methods or machines for constructing or manufacturing the components and/or systems. In at least some instances, the approximating language may correspond to the precision of an instrument for measuring the value, or the precision of the methods or machines for constructing or manufacturing the components and/or systems. For example, the approximating language may refer to being within a 1, 2, 4, 5, 10, 15, or 20 percent margin in either individual values, range(s) of values and/or endpoints defining range(s) of values. Here and throughout the specification and claims, range limitations are combined and interchanged, such ranges are identified and include all the sub-ranges contained therein unless context or language indicates otherwise. For example, all ranges disclosed herein are inclusive of the endpoints, and the endpoints are independently combinable with each other.

FIG. 1 is a schematic view of a turbine engine 10. As a non-limiting example, the turbine engine 10 can be used within an aircraft. The turbine engine 10 can include, at least, a compressor section 12, a combustion section 14, and a turbine section 16. A drive shaft 18 rotationally couples the compressor section 12 and turbine section 16, such that rotation of one affects the rotation of the other, and defines a rotational axis 20 for the turbine engine 10.

The compressor section 12 can include a low-pressure (LP) compressor 22, and a high-pressure (HP) compressor 24 serially fluidly coupled to one another. The turbine section 16 can include an HP turbine 26, and an LP turbine 28 serially fluidly coupled to one another. The drive shaft 18 can operatively couple the LP compressor 22, the HP compressor 24, the HP turbine 26 and the LP turbine 28 together. Alternatively, the drive shaft 18 can include an LP drive shaft (not illustrated) and an HP drive shaft (not illustrated). The LP drive shaft can couple the LP compressor 22 to the LP turbine 28, and the HP drive shaft can couple the HP compressor 24 to the HP turbine 26. An LP spool can be defined as the combination of the LP compressor 22, the LP turbine 28, and the LP drive shaft such that the rotation of the LP turbine 28 can apply a driving force to the LP drive shaft, which in turn can rotate the LP compressor 22. An HP spool can be defined as the combination of the HP compressor 24, the HP turbine 26, and the HP drive shaft such that the rotation of the HP turbine 26 can apply a driving force to the HP drive shaft which in turn can rotate the HP compressor 24.

The compressor section 12 can include a plurality of axially spaced stages. Each stage includes a set of circumferentially-spaced rotating blades and a set of circumferentially-spaced stationary vanes. The compressor blades for a stage of the compressor section 12 can be mounted to a disk, which is mounted to the drive shaft 18. Each set of blades for a given stage can have its own disk. The vanes of the compressor section 12 can be mounted to a casing which can extend circumferentially about the turbine engine 10. It will be appreciated that the representation of the compressor section 12 is merely schematic and that there can be any number of blades, vanes and stages. Further, it is contemplated that there can be any number of other components within the compressor section 12.

Similar to the compressor section 12, the turbine section 16 can include a plurality of axially spaced stages, with each stage having a set of circumferentially-spaced, rotating blades and a set of circumferentially-spaced, stationary vanes. The turbine blades for a stage of the turbine section 16 can be mounted to a disk which is mounted to the drive shaft 18. Each set of blades for a given stage can have its own disk. The vanes of the turbine section can be mounted to the casing in a circumferential manner. It is noted that there can be any number of blades, vanes and turbine stages as the illustrated turbine section is merely a schematic representation. Further, it is contemplated that there can be any number of other components within the turbine section 16.

The combustion section 14 can be provided serially between the compressor section 12 and the turbine section 16. The combustion section 14 can be fluidly coupled to at least a portion of the compressor section 12 and the turbine section 16 such that the combustion section 14 at least partially fluidly couples the compressor section 12 to the turbine section 16. As a non-limiting example, the combustion section 14 can be fluidly coupled to the HP compressor 24 at an upstream end of the combustion section 14 and to the HP turbine 26 at a downstream end of the combustion section 14.

During operation of the turbine engine 10, ambient or atmospheric air is drawn into the compressor section 12 via a fan (not illustrated) upstream of the compressor section 12, where the air is compressed defining a pressurized air. The pressurized air can then flow into the combustion section 14 where the pressurized air is mixed with fuel and ignited, thereby generating combustion gases. Some work is extracted from these combustion gases by the HP turbine 26, which drives the HP compressor 24. The combustion gases are discharged into the LP turbine 28, which extracts additional work to drive the LP compressor 22, and the exhaust gas is ultimately discharged from the turbine engine 10 via an exhaust section (not illustrated) downstream of the turbine section 16. The driving of the LP turbine 28 drives the LP spool to rotate the fan (not illustrated) and the LP compressor 22. The pressurized airflow and the combustion gases can together define a working airflow that flows through the fan, compressor section 12, combustion section 14, and turbine section 16 of the turbine engine 10.

Figure 2:
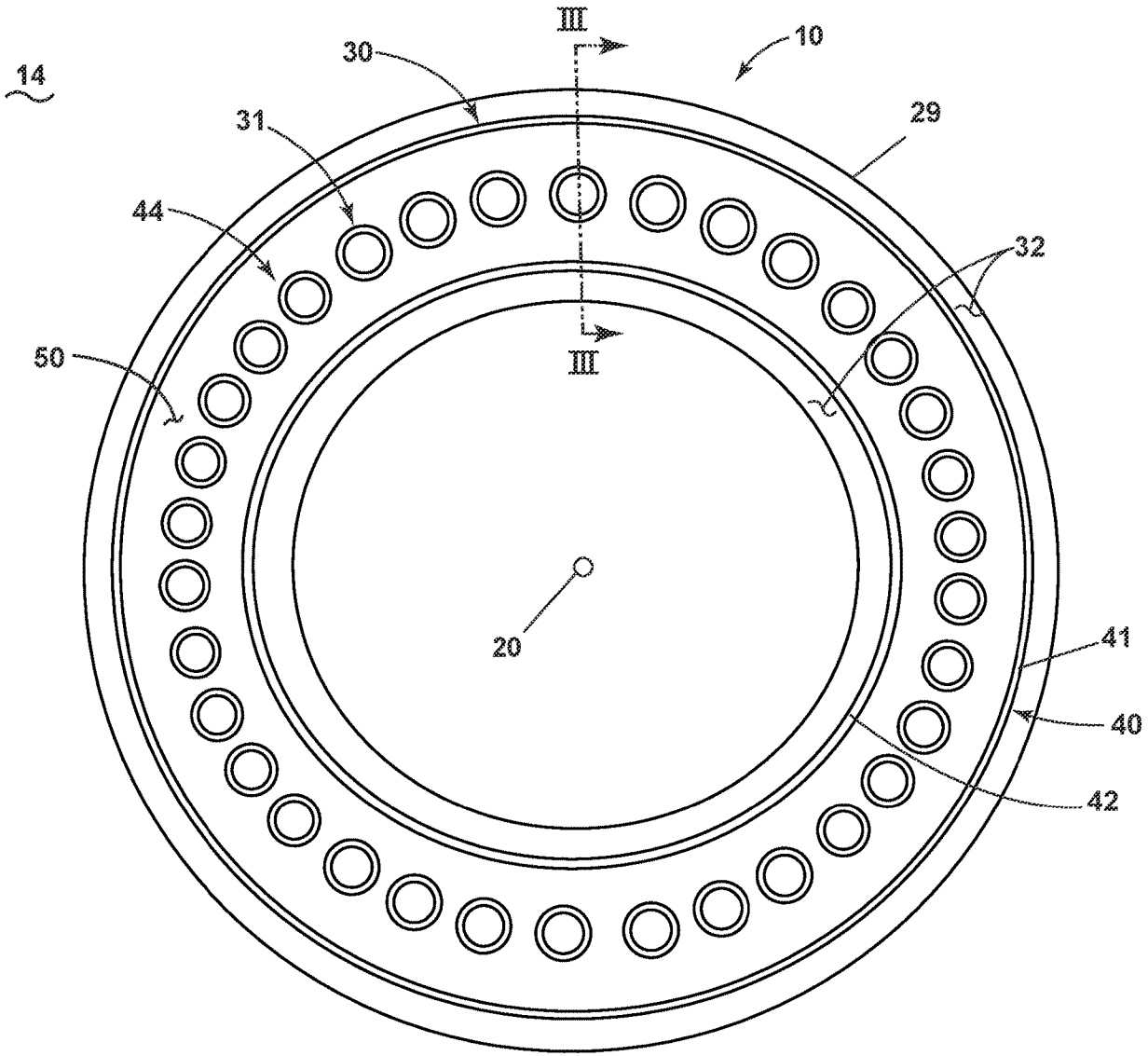
FIG. 2 is a cross-sectional view of the combustion section of FIG. 1 along line II-II in accordance with various aspects described herein.

FIG. 2 depicts a cross-sectional view of the combustion section 14 along line II-II of FIG. 1. The combustion section 14 can include a combustor 30 with an annular arrangement of fuel injectors 31 disposed around the centerline or rotational axis 20 of the turbine engine 10. It should be appreciated that the annular arrangement of fuel injectors 31 can be one or multiple fuel injectors, and one or more of the fuel injectors 31 can have different characteristics. The combustor 30 can have a can, can-annular, or annular arrangement depending on the type of engine in which the combustor 30 is located. In a non-limiting example, the combustor 30 can have a combination arrangement located with a casing 29 of the engine.

The combustor 30 can be at least partially defined by a combustor liner 40. In some examples, the combustor liner 40 can include an outer liner 41 and an inner liner 42 concentric with respect to each other and arranged in an annular fashion about the engine centerline or rotational axis 20. In some examples, the combustor liner 40 can have an annular structure about the combustor 30. In some examples, the combustor liner 40 can include multiple segments or portions collectively forming the combustor liner 40. A dome assembly 44 together with the combustor liner 40 can at least partially define a combustion chamber 50 arranged annularly about the rotational axis 20. A compressed air passage 32 can be defined at least in part by both the combustor liner 40 and the casing 29.

Figure 3:
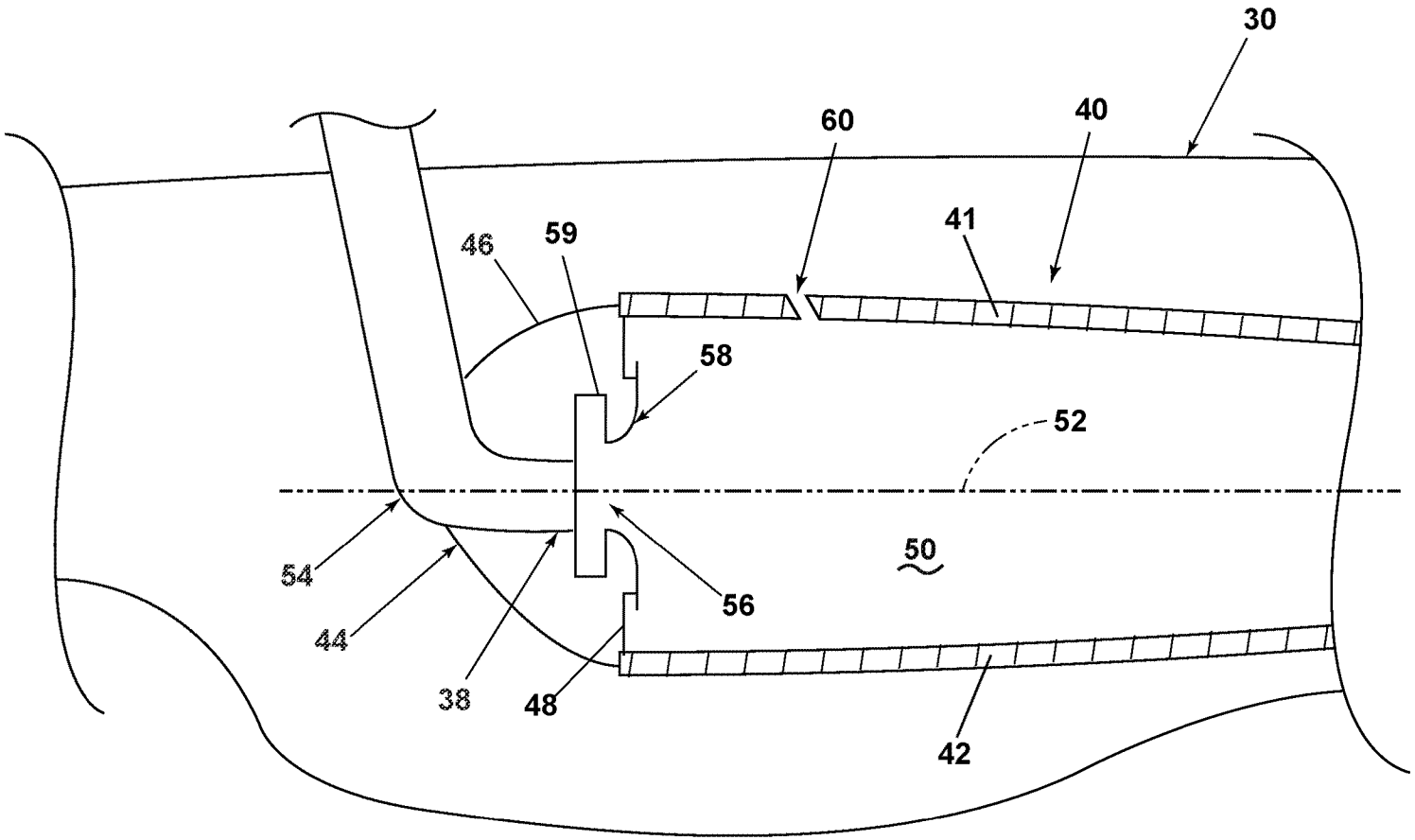
FIG. 3 is a cross-sectional view along line of FIG. 2 illustrating a combustor in accordance with various aspects described herein.

FIG. 3 depicts a cross-sectional view taken along line of FIG. 2 illustrating the combustor 30. The combustor 30 can include a fuel nozzle assembly 38 for providing fuel to the combustor 30. In some examples, the fuel nozzle assembly 38 can include an annular arrangement of fuel nozzles. It should be appreciated that the fuel nozzle assemblies 38 can be organized in any suitable arrangement, pattern, grouping, or the like. The combustor 30 can have a can, can-annular, or annular arrangement depending on the type of engine in which the combustor 30 is located. In some examples, the fuel injector 31 (FIG. 2) can be incorporated into the fuel nozzle assembly 38.

The combustor 30 can also include the combustor liner 40. In some examples, the combustor liner 40 can have an annular structure about the combustor 30. In some examples, the combustor liner 40 can include multiple segments or portions collectively forming the combustor liner 40. In some examples, the combustor liner 40 can include the outer liner 41 radially spaced from the inner liner 42. In some examples, the combustor liner 40 can include a single liner.

The dome assembly 44 can also be provided in the combustor 30. The dome assembly 44 can include a cowl 46 and a deflector 48. The combustor liner 40 and dome assembly 44 can collectively at least partially define the combustion chamber 50 about a longitudinal axis 52. At least one fuel supply 54 can be fluidly coupled to the combustion chamber 50 to supply fuel to the combustor 30. The fuel can include any suitable fuel, including hydrocarbon fuel or hydrogen fuel in non-limiting examples.

The fuel supply 54 can be disposed within the dome assembly 44 to define a fuel outlet 56. A flare cone 58 can be provided downstream of the fuel supply 54 in some examples. A swirler 59 can also be provided at the fuel nozzle assemblies 38 to swirl incoming air in proximity to fuel exiting the fuel supply 54 and provide a homogeneous mixture of air and fuel entering the combustor 30.

A set of dilution holes 60 can be provided in the combustor liner 40 and configured to direct compressed air from the HP compressor 24 (FIG. 1) into the combustion chamber 50 for temperature control, flame shaping, fuel-air mixing, or the like. While a single dilution hole is illustrated, for purposes of this description and its novel combustor, any number can be provided in the set of dilution holes 60.

Figure 4:
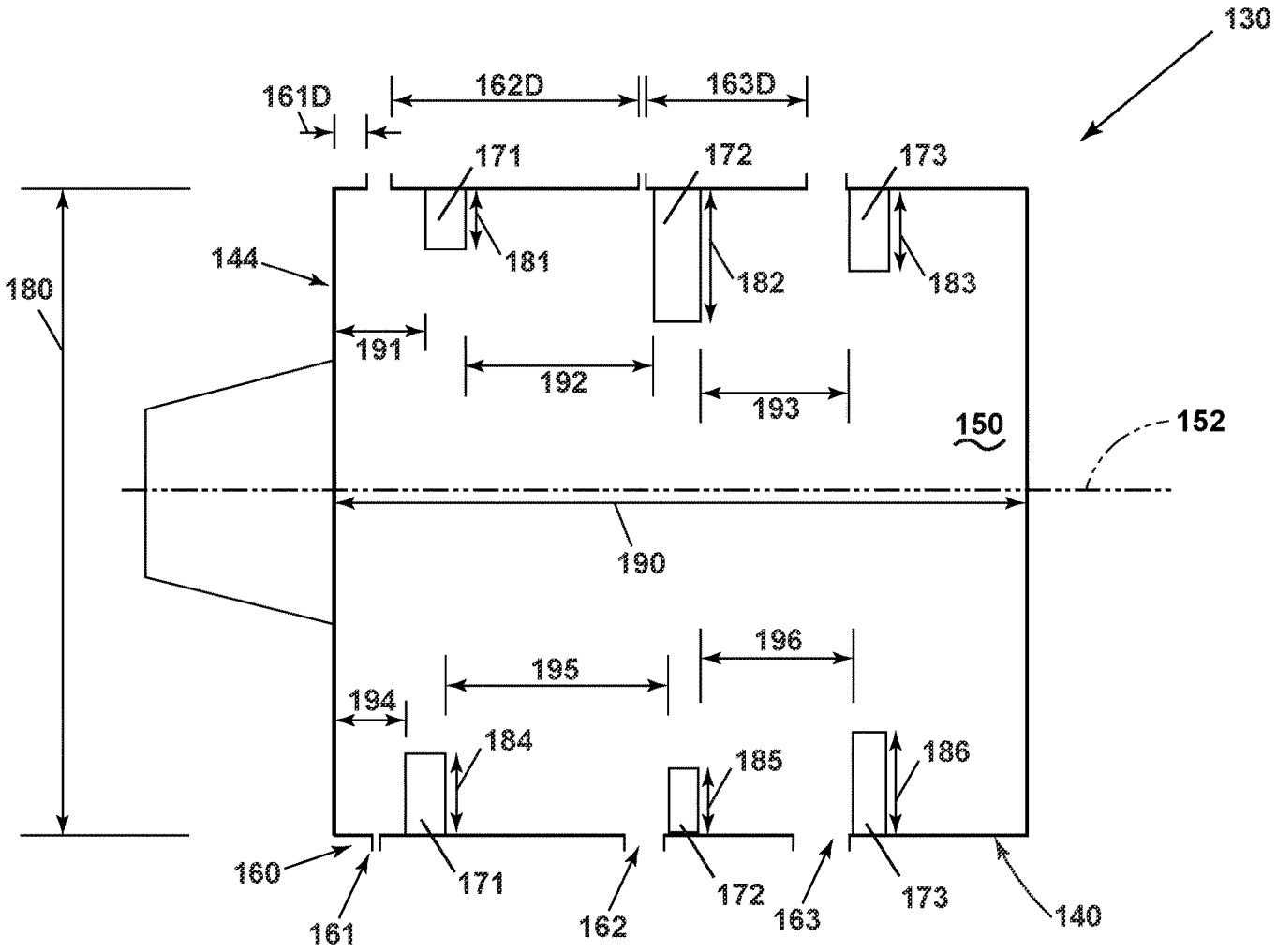
FIG. 4 is a cross-sectional view of another combustor that can be utilized in the turbine engine of FIG. 1 including a combustor liner in accordance with various aspects described herein.

Turning to FIG. 4, a portion of another combustor 130 is shown that can be utilized in the combustion section 14 (FIG. 1). The combustor 130 is similar to the combustor 30; therefore, like parts will be described with like numerals increased by 100, with it being understood that the description of the like parts of the combustor 30 applies to the combustor 130, except where noted. The combustor 130 has many novel aspects related to the type and arrangement of dilutions holes, and corresponding structures, which make it very suitable for use in combusting gaseous fuels, such as hydrogen, having molecules less dense than air.

The combustor 130 can include a combustor liner 140, a dome assembly 144, a combustion chamber 150, and a set of dilution holes 160. The set of dilution holes 160 can include one or more cooling apertures in the combustor liner 140 configured to direct compressed air into the combustion chamber 150. The combustor 130 can also define a longitudinal axis or combustor axis 152 as shown.

One difference compared to the combustor 30 is that the set of dilution holes 160 can include multiple discrete or continuous apertures in the combustor liner 140. The set of dilution holes 160 can include any number of dilution holes, openings, or the like. The set of dilution holes 160 can be provided on any portion of the combustor liner 140. The set of dilution holes 160 is illustrated schematically with rectangular openings or apertures in the example of FIG. 4. However, the set of dilution holes 160 can have any suitable aperture profile, size, patterning, arrangement, or number over the combustor liner 140, including circular holes, elongated holes, extended slots, linear rows, irregular groups, an annular arrangement about the combustor liner 140, variable or constant hole diameters, variable or constant slot widths, or the like, or combinations thereof.

In the example shown, the set of dilution holes 160 can include a first aperture 161, a second aperture 162, and a third aperture 163 although any number of apertures can be provided. In addition, in the example shown, the first aperture 161, second aperture 162, and third aperture 163 can include one or multiple slots extending at least partially about the combustor liner 140 in an annular direction.

Another difference compared to the combustor 30 is that the combustor liner 140 can include a set of projecting walls or fences configured to protrude into the combustion chamber 150. Such projecting walls or fences can be positioned adjacent some dilution holes in the set of dilution holes 160 in some examples. In addition, it is contemplated that such projecting walls or fences can optionally include apertures for air flow in some examples.

In the non-limiting example shown, a first fence wall 171, a second fence wall 172, and a third fence wall 173 are positioned downstream of the respective first aperture 161, second aperture 162, and third aperture 163, respectively. In some examples, the first fence wall 171, second fence wall 172, or third fence wall 173 can be positioned immediately downstream, be spaced from, or at least partially overlap the respective first aperture 161, second aperture 162, and third aperture 163. In some examples, the combustor 130 can include only a single wall or fence. In some examples, the combustor 130 can include more than three walls or fences.

In one non-limiting example where the combustor liner 140 includes an outer liner and an inner liner, the first fence wall 171, second fence wall 172, and third fence wall 173 can project from the inner liner. In another non-limiting example where the combustor 140 includes a single liner, the first fence wall 171, second fence wall 172, and third fence wall 173 can project from the single liner.

A dome height 180 can be defined in the combustor 130 as shown. In addition, the first fence wall 171, second fence wall 172, and third fence wall 173 can define a respective first height 181, a second height 182, and a third height 183. The first height 181, second height 182, and third height 183 can have any suitable size. In one non-limiting example, any of the first, second, or third heights 181, 182, 183 can be between 1 mm and 30 mm.

The first height 181, second height 182, and third height 183 can also have any suitable size relative to one another. For example, the first height 181 can be the same as, larger than, or smaller than the second height 182. The second height 182 can be the same as, larger than, or smaller than the third height 183. The first height 181 can be the same as, larger than, or smaller than the third height 183. In the non-limiting example shown, the first height 181 is smaller than both the second height 182 and third height 183, and the third height 183 is smaller than the second height 182.

It is further contemplated that any of the first fence wall 171, second fence wall 172, or third fence wall 173 can have a variable length in an annular direction about the combustor 30. Additionally or alternatively, the first fence wall 171, second fence wall 172, or third fence wall 173 can include multiple discrete or separated segments collectively forming the wall. In the example shown, the first fence wall 171 includes a fourth height 184, the second fence wall 172 includes a fifth height 185, and the third fence wall 173 includes a sixth height 186 at another portion of the combustor 130, e.g. at another portion of the combustor liner 140, compared to the respective first, second, and third heights 181, 182, 183. The fourth height 184 can be the same as, larger than, or smaller than the first height 181. The fifth height 185 can be the same as, larger than, or smaller than the second height 182. The sixth height 186 can be the same as, larger than, or smaller than the third height 183.

The first, second, third, fourth, fifth, and sixth heights 181, 182, 183, 184, 185, 186 can also have predetermined ratios with respect to one another or with respect to the dome height 180. In some non-limiting examples: a ratio of the first height 181 to the fourth height 184 can be 0.1-5; a ratio of the second height 182 to the fifth height 185 can be 0.1-5; a ratio of the third height 183 to the sixth height 186 can be 0.1-5; the first height 181 can be 0.005-0.2 times the dome height 180; a ratio of the second height 182 to the first height 181 can be 0-15; a ratio of the fifth height 185 to the fourth height 184 can be 0-15; a ratio of the third height 183 to the first height 181 can be 0-15; or a ratio of the sixth height 186 to the first height 181 can be 0-15.

The combustor 130 can also define a combustor length 190 as shown. In addition, the first fence wall 171, second fence wall 172, and third fence wall 173 can define a respective first length 191, a second length 192, and a third length 193 in a first portion of the combustor 130 along an axial direction as shown. The first length 191 can be defined with respect to the dome assembly 144, along the combustor axis 152. The second length 192 can be defined between the first fence wall 171 and the second fence wall 172. The third length 193 can be defined between the second fence wall 172 and the third fence wall 173.

The first fence wall 171, second fence wall 172, and third fence wall 173 can additionally define a respective fourth length 194, a fifth length 195, and a sixth length 196 in a second portion, e.g. at another portion of the combustor liner 140, of the combustor 130 as shown. The fourth length 194 can be defined with respect to the dome assembly 144, along the combustor axis 152. The fifth length 195 can be defined between the first fence wall 171 and the second fence wall 172. The sixth length 196 can be defined between the second fence wall 172 and the third fence wall 173.

The first, second, third, fourth, fifth, and sixth lengths 191, 192, 193, 194, 195, 196 can also have predetermined ratios with respect to one another or with respect to the combustor length 190. In some non-limiting examples: the first length 191 can be 0.01-0.2 times the combustor length 190; the fourth length 194 can be 0.01-0.2 times the combustor length 190; the second length 192 can be 0.1-0.6 times the combustor length 190; the fifth length 195 can be 0.1-0.6 times the combustor length 190; the third length 193 can be 0.1-0.7 times the combustor length 190; the sixth length 196 can be 0.1-0.7 times the combustor length 190; the first length 191 and the fourth length 194 can be the same size or have differing sizes; the fifth length 195 can be larger than, smaller than, or the same as the second length 192; or the sixth length 196 can be larger than, smaller than, or the same as the third length 193.

In addition, the first aperture 161 can define a first aperture distance 161D with respect to the dome assembly 144 as shown. The first aperture distance 161D can be defined between the dome assembly 144 and a forward edge of the first aperture 161. In a non-limiting example, the first aperture distance 161D can be between 0.01-0.2 times the combustor length 190.

The second aperture 162 can define a second aperture distance 162D with respect to the first aperture 161. The second aperture distance 162D can be defined between an aft edge of the first aperture 161 and a forward edge of the second aperture 162. In a non-limiting example, the second aperture distance 162D can be between 0.1-0.6 times the combustor length 190.

The third aperture 163 can define a third aperture distance 163D with respect to the second aperture 162. The third aperture distance 163D can be defined between an aft edge of the second aperture 162 and a forward edge of the third aperture 163. In a non-limiting example, the third aperture distance 183D can be between 0.1-0.7 times the combustor length 190.

Figure 5:
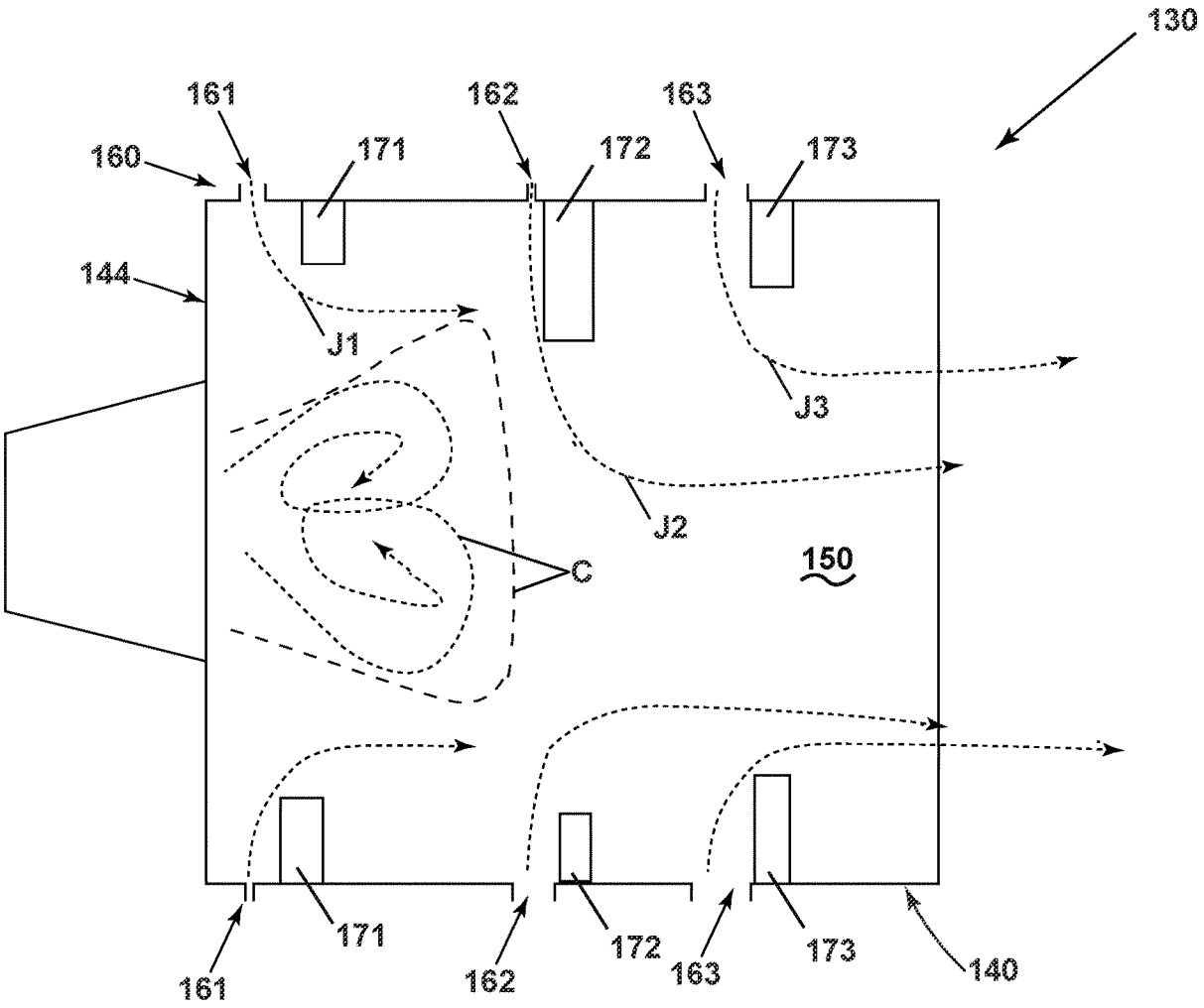
FIG. 5 is a cross-sectional view of the combustor of FIG. 4 illustrating fluid flows.

FIG. 5 illustrates some exemplary flows paths through the combustion chamber 150. Some exemplary combustion flows C are illustrated within the combustion chamber 150. A first jet flow J1, a second jet flow J2, and a third jet flow J3 are shown entering the combustion chamber 150 through the respective first aperture 161, second aperture 162, and third aperture 163. During operation, the first aperture 161 can be configured to direct the first jet flow J1 such that combustion flows C or the combustion flame are kept away from the combustor liner 140 in a region proximate the dome assembly 144. The first fence wall 171, second fence wall 172, and third fence wall 173 can be configured to direct the respective jet flows J1, J2, J3 into the center of the combustion chamber 150. In this manner, the first fence wall 171, second fence wall 172, and third fence wall 173 can control air flow jet penetration through the set of dilution holes 160 to achieve desired flame structure, as well as reducing or at least partially quenching the flame in the core of the combustor 130 with lower turbulence. In this manner, the set of dilution holes 160, first fence wall 171, second fence wall 172, and third fence wall 173 can be configured to direct dilution jet flows J1, J2, J3 into the combustion chamber 150, reduce core temperature, and form or shape a desired exit profile and pattern factor for combustion gas flows exiting the combustor 130.

It is also contemplated that an amount of air entering the combustion chamber 150 can vary across the set of dilution holes 160, including varying between the first aperture 161, second aperture 162, and third aperture 163. In some non-limiting examples: the first jet flow J1 can be greater than, less than, or equal to the second jet flow J2; the second jet flow J2 can be greater than, less than, or equal to the third jet flow J3; the first jet flow J1 can be greater than, less than, or equal to the third jet flow J3; the first jet flow J1 can have 1-20% of the total dilution flow through the set of dilution holes 160; the third jet flow J3 can have 0-40% of the total dilution flow through the set of dilution holes 160, or the second jet flow J2 can have 80-100% of the total dilution flow through the set of dilution holes 160. It will be understood that the first, second, and third jet flows J1, J2, J3 can have any relative size with respect to one another. In this manner, the first, second, and third jet flows J1, J2, J3 can achieve desired flow splits through the set of dilution holes 160, providing for lower $NO_x$ emission, shaping a desired combustion gas temperature profile exiting the combustor 130, and keeping the combustion flame away from the combustor liner 140 for improved durability.

In one non-limiting example where hydrogen fuel is utilized, the first aperture 161 can direct the lightweight hydrogen and air mixture away from the combustor liner 140 by way of the first jet flow J1. The second and third apertures 162, 163 and walls 171, 172, 173 can introduce additional compressor air and further direct the lightweight hydrogen and air mixture to the center of the combustion chamber 150, providing for combustion gas flow shaping by way of the fence walls 171, 172, 173 and keeping the combustion flame away from the combustor liner 140 as described above.

Figure 6:
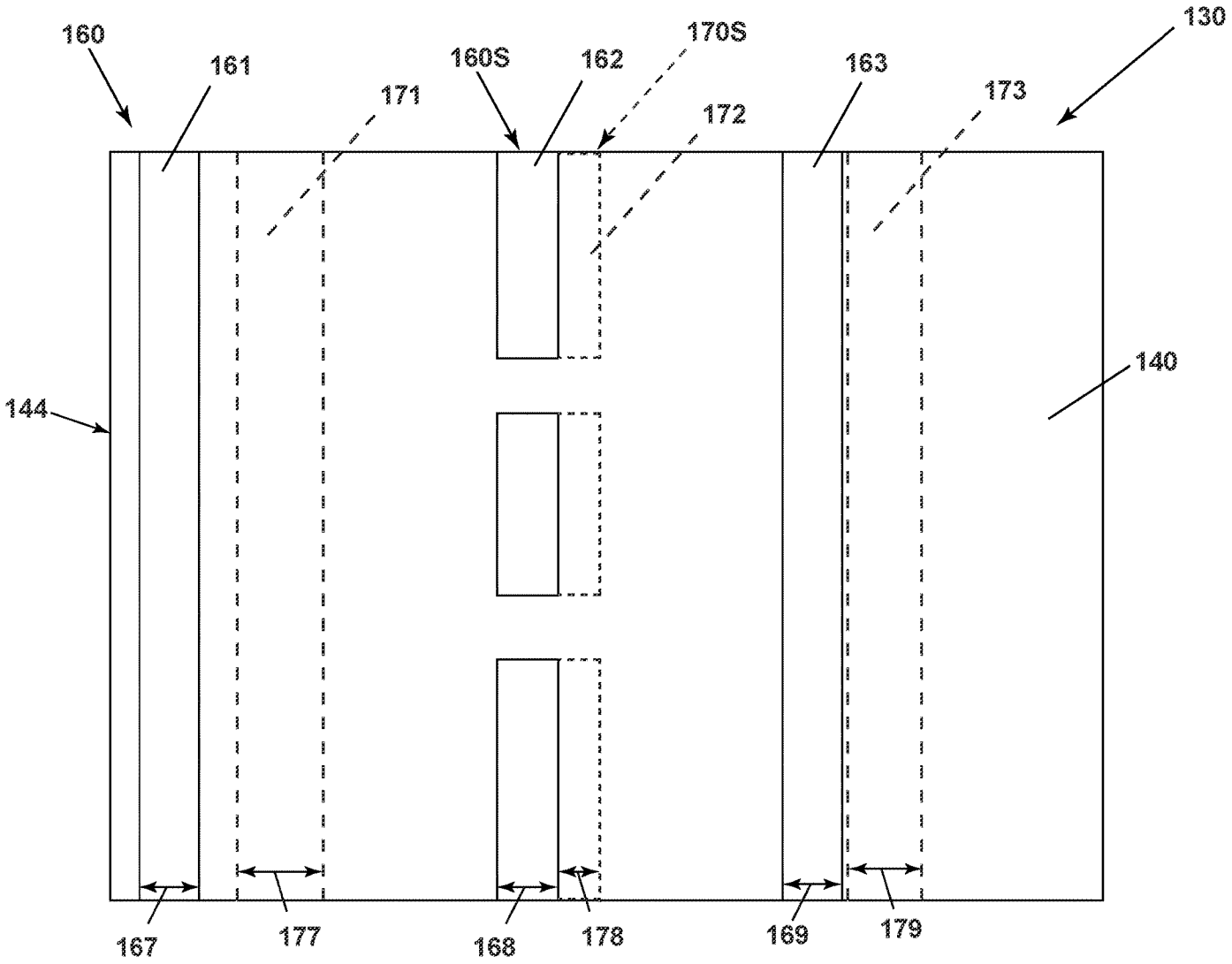
FIG. 6 illustrates a top view of the combustor liner of FIG. 4.

FIG. 6 schematically illustrates a schematic top view of a portion of the combustor liner 140 with the set of dilution holes 160, including the first aperture 161, second aperture 162, and third aperture 163, as well as the first fence wall 171, second fence wall 172, and third fence wall 173. While only a portion is shown, it should be appreciated that the combustor liner 140 can be in an annular arrangement, with the fence walls, slots, and holes in a similar annular arrangement.

The first aperture 161, second aperture 162, and third aperture 163 can define a respective first aperture width 167, a second aperture width 168, and a third aperture width 169 as shown. In addition, the first fence wall 171, second fence wall 172, and third fence wall 173 can define a respective first fence wall width 177, second fence wall width 178, and third fence wall width 179 as shown. The first aperture width 167, second aperture width 168, third aperture width 169, first fence wall width 177, second fence wall width 178, and third fence wall width 179 can have any suitable size, including any relative size with respect to one another. The first aperture width 167, second aperture width 168, or third aperture width 169 can be between 0.5 mm and 15 mm, or between 1 mm and 4 mm, in some non-limiting examples. The first fence wall width 177, second fence wall width 178, or third fence wall width 179 can be between 0.5 and 15 mm, or between 1 mm and 4 mm, in some non-limiting examples.

The set of dilution holes 160 can extend axially along a portion of the combustor liner 140, such as to a midpoint or mid-length of the combustor liner 140 in one non-limiting example. In other examples, the set of dilution holes 160 can be arranged or spaced along the entire axial extent of the combustor liner 140.

In addition, in the example shown, the second aperture 162 can include a set of discrete apertures 160S circumferentially arranged about the combustor liner 140. The set of discrete apertures 160S can include multiple, discrete, circumferentially-extending slots extending at least partially about the combustor liner 140. The second fence wall 172 can also include a set of discrete walls 170S circumferentially arranged about the combustor liner 140. The set of discrete walls 170S can include multiple discrete walls positioned downstream of the multiple discrete slots collectively forming the second aperture 162. Any combination of singular apertures, multiple discrete apertures, partial or fully-annular circumferential slot, with optional downstream walls or fences, can be provided.

Figure 7:
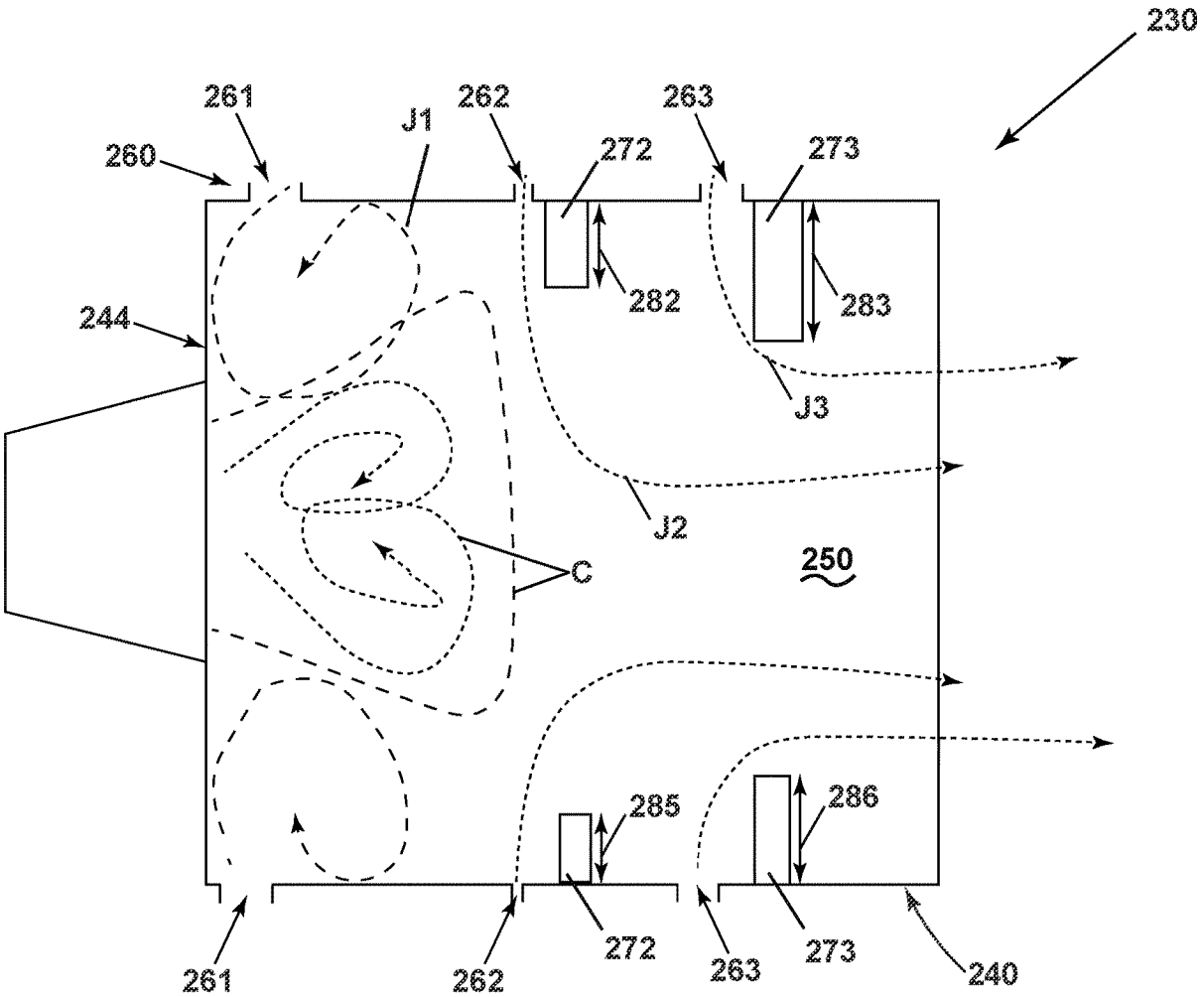
FIG. 7 is a cross-sectional view of another combustor that can be utilized in the turbine engine of FIG. 1 including another combustor liner in accordance with various aspects described herein.

Referring now to FIG. 7, a portion of another combustor 230 is shown that can be utilized in the combustion section 14 (FIG. 1). The combustor 230 is similar to the combustor 30, 130; therefore, like parts will be described with like numerals further increased by 100, with it being understood that the description of the like parts of the combustor 30, 130 applies to the combustor 230, except where noted.

The combustor 230 can include a combustor liner 240, a dome assembly 244, a combustion chamber 250, and a set of dilution holes 260. The set of dilution holes 260 can include any number of dilution holes, openings, apertures, or the like. The set of dilution holes can be provided on any portion of the combustor liner 240. The set of dilution holes 260 is illustrated schematically with rectangular openings in the example of FIG. 5, and it will be understood that the set of dilution holes 260 can have any suitable aperture profile, size, patterning, arrangement, or number over the combustor liner 240, including linear rows, irregular groups, an annular arrangement about the combustor liner 240, variable hole diameters, constant hole diameters, or the like, or combinations thereof.

The set of dilution holes 260 can include a first aperture 261, a second aperture 262, and a third aperture 263. One difference compared to the combustor 30, 130 is that the first aperture 261 can include a row of discrete dilution holes positioned annularly about the combustor liner 240. The first aperture 261 can be positioned in close proximity to the dome assembly 244. In the non-limiting example shown, the second aperture 262 and the third aperture 263 can each include slots extending annularly about the combustor liner 140. It is also contemplated that an amount of air entering the combustion chamber 250 can vary across the set of dilution holes 260.

A set of projecting walls or fences can also be provided in the combustor 230. Another difference compared to the combustor 30, 130 is that the first aperture 261 does not include a projecting wall or fence, previously referred to as a first fence wall having a first height. A second fence wall 272 can be positioned downstream of the second aperture 262, and a third fence wall 273 can be positioned downstream of the third aperture 263. The second fence wall 272 or third fence wall 273 can include a continuous wall extending annularly about the combustor 230, or include multiple discrete or separated segments collectively forming the wall, in some examples.

The second fence wall 272 and third fence wall 273 can define a respective second height 282 and third height 283. The second height 282 can be the same as, larger than, or smaller than the third height 283. In addition, either or both of the second fence wall 272 or third fence wall 273 can have a variable height, including in an annular direction about the combustor 230. In the non-limiting example shown, the second fence wall 272 defines the second height 282 in a first portion of the combustor 230 and a fifth height 285 in a second portion of the combustor 230. In addition, in the non-limiting example shown, the third fence wall 273 defines the third height 283 in a first portion of the combustor 230 and a sixth height 286 in a second portion of the combustor 230.

The second, third, fifth, and sixth heights 282, 283, 285, 286 can also be formed with respective ratios. In some non-limiting examples: a ratio of the second height 282 to the fifth height 285 can be 0.1-5; a ratio of the third height 283 to the sixth height 286 can be 0.1-5; a ratio of the third height 283 to the second height 282 can be 0-15; or a ratio of the fifth height 285 to the sixth height 286 can be 0-1.5.

Some exemplary combustion flows C are also illustrated within the combustion chamber 250. A first jet flow J1 can enter the combustion chamber 250 through the first aperture 261, a second jet flow J2 can enter through the second aperture 262, and a third jet flow J3 can enter through the third aperture 263. During operation, the first aperture 261 can be configured to direct the first jet flow J1 such that combustion flows C or the combustion flame are kept away from the combustor liner 140 in a region proximate the dome assembly 244. The second aperture 262 and second fence wall 272 can be configured to direct the second jet flow J2 into the center of the combustion chamber 150 and reduce or at least partially quench the flame in the core of the combustor 230 with lower turbulence. The third aperture 263 and third fence wall 273 can be configured to direct the third jet flow J3 into the combustion chamber 250, reduce core temperature, and form or shape a desired exit profile and pattern factor for combustion gas flows exiting the combustor 230. In this manner, the height of the fence walls 272, 273 can be selected or adjusted to change or shape a location of peak exit temperature profile within the combustor 230. In one example where the third height 283 is smaller than the fifth height 285, a peak exit temperature location can be formed closer to one side of the combustion chamber 250 due to asymmetric jet flow directions.

In some non-limiting examples where the second height 282 differs from the fifth height 285, or where the third height 283 differs from the sixth height 286, a desired exit temperature distribution of the combustion gases exiting the combustion chamber 250 can be formed due to asymmetric jet flow penetration.

Figure 8:
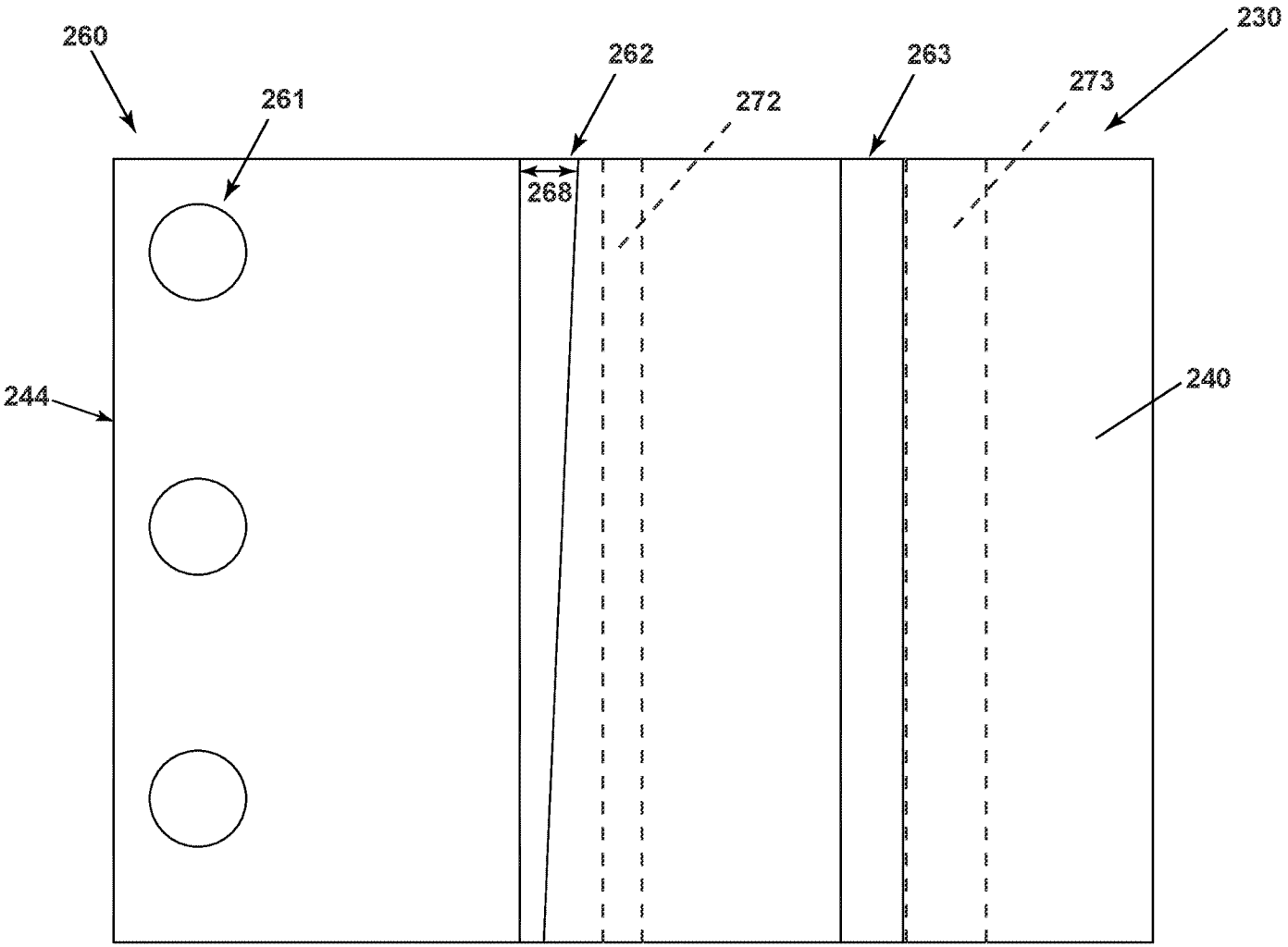
FIG. 8 illustrates a top view of the combustor liner of FIG. 7.

FIG. 8 illustrates a schematic top view of a portion of the combustor liner 240 with the set of dilution holes 260, including the first aperture 261, second aperture 262, and third aperture 263, as well as the second fence wall 272 and third fence wall 273.

The set of dilution holes 260 can extend axially along a portion of the combustor liner 240, including to a midpoint or mid-length of the combustor liner 240 in a non-limiting example. In other examples, the set of dilution holes 260 can be arranged or spaced along the entire axial extent of the combustor liner 240.

In the non-limiting example shown, the first aperture 261 can include the row of discrete dilution holes as described above in FIG. 6. The first aperture 261 can include the dilution holes extending in a ring fully about the combustor liner 240 in a circumferential direction, or extend partially about the combustor liner 240 in a circumferential direction, or include multiple groupings of dilution holes, in some examples. The second aperture 262 and third aperture 263 can include elongated slots extending at least partially about the combustor liner 240 in a circumferential direction. The second fence wall 272 and third fence wall 273 can be positioned downstream of the respective second aperture 262 and third aperture 263 as shown.

Another difference compared to the combustor 30, 130 is that the second aperture 262 can have a second aperture width 268 that is non-constant along the combustor liner 240. In the non-limiting example shown, the second aperture width 268 can form a variable slot width in at least a circumferential direction about the combustor liner 240. In another non-limiting example, the second aperture width 268 can include a slot width having narrower portions circumferentially adjacent to wider portions, such that the slot width alternates between wide and narrow along different circumferential portions of the combustor liner 240.

Further aspects of the disclosure will be described below with some additional exemplary implementations. It will be understood that such examples are provided for illustrative purposes and do not limit the disclosure in any way.

In one example, the set of dilution holes can include first and second rows of discrete dilution holes each extending in a ring circumferentially about the combustor liner. The first row can be located in close proximity to the dome assembly, and the second row can be located downstream of the first row. In some examples, the first row can include larger dilution holes than the second row. In some examples, the first and second rows can have equally-sized dilution holes. An annular slot can be positioned downstream of both rows. A projecting fence can be positioned immediately downstream of the annular slot. In this manner, the combustor liner can provide two rows of discrete dilution jets and a slot providing a third dilution jet, with the third dilution jet being directed toward the center of the combustion chamber and configured to shape combustion gas flows by way of the projecting fence.

In another example, the set of dilution holes can include a single row of discrete dilution holes positioned adjacent the dome assembly and a single annular slot downstream of the row of discrete dilution holes. A fence can be provided downstream of the annular slot. In this manner, the combustor liner can provide a row of discrete dilution jets as well as a slot-provided dilution jet configured to shape combustion gas flows by way of the fence.

In another example, the set of dilution holes can include a row of discrete dilution holes located adjacent the dome assembly, and multiple slots positioned downstream of the row. In some examples, the multiple slots can include an annular slot and multiple discrete slots collectively forming a ring extending about the combustor liner. In some examples, a fence can be positioned downstream of each of the annular slot and the multiple discrete slots. In some examples, multiple discrete fences can be positioned downstream of each discrete slot in the multiple discrete slots. In some examples, discrete slots can be arranged over multiple rows and be circumferentially staggered with one another. Corresponding circumferentially-staggered fences can also be provided downstream of the circumferentially-staggered slots.

In another example, the set of dilution holes can include an annular slot extending about the combustor liner with no fence provided. In such a case, the jet flow entering the combustor can remain close to the combustor liner, providing cooling for the liner and shaping of the flame to be away from the liner.

The described aspects of the present disclosure provide for multiple benefits, including that the set of dilution holes or protruding walls/fences can provide a more uniform temperature distribution downstream of the dilution jets. Such an improved temperature distribution can also reduce undesirable emissions, including NOR. The set of dilution holes and fences can also provide for modifying or tailoring a location of peak combustor exit temperature profile or pattern. The fences described herein can provide multiple benefits, including that taller fences can provide for flame quenching or flow mixing within the combustion chamber and shorter fences can provide for cooling of the combustor liner. The set of dilution holes or protruding walls can provide for a reduced environment temperature on the deflector and liner, which can improve part lifetimes.

In addition, the use of higher-volume jet flows close to the dome assembly can provide for quenching the temperature in the core of the combustor, as well as controlling a region of maximum heat release between (e.g.) the first jet flow and second jet flow. The use of a lower-volume jet flow (e.g. third jet flow) in aft portions of the combustor liner can provide for lower temperatures near the liner at the aft end of the combustor. The use of a lower-volume jet flows can provide for shaping the flame away from the fence, and the user of a higher jet flow can help quench the flame to achieve a uniform temperature distribution.

The multiple tailored jet flows described herein can provide for shaping or tailoring the exit temperature profile to a desired distribution, which also provides for increased part lifetimes. The use of annular slot flows can form a well-defined film on the fences, the outer liner, and the inner liner, which can provide for a circumferentially-uniform flow distribution which improves heat release control uniformly over the entire combustor liner circumference.

To the extent not already described, the different features and structures of the various embodiments can be used in combination, or in substitution with each other as desired. That one feature is not illustrated in all of the embodiments is not meant to be construed that it cannot be so illustrated, but is done for brevity of description. Thus, the various features of the different embodiments can be mixed and matched as desired to form new embodiments, whether or not the new embodiments are expressly described. All combinations or permutations of features described herein are covered by this disclosure.

Further aspects of the disclosure are provided by the following clauses:

A turbine engine, comprising a compressor section, a combustion section, and a turbine section in serial flow arrangement, and the combustion section having a combustor defining a combustor axis and comprising: a combustor liner at least partially defining a combustion chamber, a dome assembly coupled to the combustor liner and at least partially defining the combustion chamber, a compressed air passage fluidly coupling the compressor section to the combustion chamber, a first aperture extending through the combustor liner adjacent the dome assembly and fluidly coupling the compressed air passage to the combustion chamber, a second aperture extending through the combustor liner and axially spaced downstream from the first aperture along the combustor axis, and a fence wall located downstream of the second aperture and projecting radially, with respect to the combustor axis, into the combustion chamber from the combustor liner.

The turbine engine of any preceding clause, further comprising multiple apertures arranged circumferentially about the combustor liner with respect to the combustor axis, with the multiple apertures including at least one of the first aperture or the second aperture.

The turbine engine of any preceding clause, wherein at least one of the first aperture or the second aperture comprises a circumferentially-extending slot.

The turbine engine of any preceding clause, wherein the combustor defines a combustor length and the first aperture defines a first aperture distance, with the combustor length and the first aperture distance defined along the combustor axis with respect to the dome assembly, wherein the first aperture distance is between 0.01-0.2 times the combustor length.

The turbine engine of any preceding clause, wherein the second aperture comprises the circumferentially-extending slot and has a variable aperture width.

The turbine engine of any preceding clause, further comprising an additional fence wall projecting radially into the combustion chamber from the combustor liner.

The turbine engine of any preceding clause, wherein the additional fence wall and the fence wall different axial positions with respect to the combustor axis.

The turbine engine of any preceding clause, wherein the additional fence wall is positioned upstream of the fence wall and downstream of the first aperture.

The turbine engine of any preceding clause, wherein the additional fence wall comprises a first height and the fence wall comprises a second height greater than the first height.

The turbine engine of any preceding clause, wherein at least one of the fence wall or the additional fence wall comprises multiple discrete walls arranged circumferentially about the combustor liner with respect to the combustor axis.

The turbine engine of any preceding clause, wherein the fence wall defines a second length from the additional fence wall, and wherein the second length is between 0.1-0.6 times the combustor length.

The turbine engine of any preceding clause, wherein the fence wall comprises a continuous fence wall extending circumferentially about the combustor liner with respect to the combustor axis.

The turbine engine of any preceding clause, further comprising a third aperture downstream of the second aperture and a third fence wall projecting radially into the combustion chamber downstream of the third aperture.

The turbine engine of any preceding clause, wherein the second aperture comprises a circumferentially-arranged set of discrete apertures, and wherein the fence wall comprises a circumferentially-arranged set of discrete walls, with each discrete wall in the set of discrete walls positioned downstream of each corresponding discrete aperture in the set of discrete apertures.

The turbine engine of any preceding clause, further comprising a third aperture extending through the combustor liner, a first fence wall, a second fence wall, and a third fence wall.

The turbine engine of any preceding clause, wherein the second fence wall is the fence wall.

The turbine engine of any preceding clause, wherein the first fence wall is the additional fence wall.

The turbine engine of any preceding clause, wherein the first fence wall comprises a first height and a fourth height, the second fence wall comprises a second height and a fifth height, and the third fence wall comprises a third height and a sixth height.

The turbine engine of any preceding clause, wherein a ratio of the first height to the fourth height is between 0.1-5.

The turbine engine of any preceding clause, wherein a ratio of the second height to the fifth height is between 0.1-5.

The turbine engine of any preceding clause, wherein a ratio of the third height to the sixth height is between 0.1-5.

The turbine engine of any preceding clause, wherein a ratio of the first height to a dome height is between 0.005-0.2.

The turbine engine of any preceding clause, wherein a ratio of the second height to the first height is between 0-15.

The turbine engine of any preceding clause, wherein a ratio of the fifth height to the fourth height is between 0-15.

The turbine engine of any preceding clause, wherein a ratio of the third height to the first height is between 0-15.

The turbine engine of any preceding clause, wherein a ratio of the sixth height to the first height is between 0-15.

The turbine engine of any preceding clause, further comprising a third aperture extending through the combustor liner, and a third fence wall downstream of the third aperture.

The turbine engine of any preceding clause, wherein the fence wall comprises a second height and a fifth height, and wherein the third fence wall comprises a third height and a sixth height.

The turbine engine of any preceding clause, wherein a ratio of the second height to the fifth height is between 0.1-5.

The turbine engine of any preceding clause, wherein a ratio of the third height to the sixth height is between 0.1-5.

The turbine engine of any preceding clause, wherein a ratio of the third height to the second height is 0-15.

The turbine engine of any preceding clause, wherein a ratio of the fifth height to the sixth height is 0-1.5.

The turbine engine of any preceding clause, further comprising a first jet flow through the first aperture, a second jet flow through the second aperture, and a third jet flow through the third aperture.

The turbine engine of any preceding clause, wherein the first jet flow is greater than the second jet flow.

The turbine engine of any preceding clause, wherein the first jet flow is greater than the third jet flow.

The turbine engine of any preceding clause, wherein the first jet flow comprises between 1-20% of a total dilution flow through the set of dilution holes.

The turbine engine of any preceding clause, wherein the third jet flow comprises between 0-40% of the total dilution flow through the set of dilution holes.

The turbine engine of any preceding clause, wherein the second jet flow comprises 80-100% of the total dilution flow through the set of dilution holes.

A combustor for a turbine engine, comprising a combustor liner at least partially defining a combustion chamber along a combustor axis, a dome assembly coupled to the combustor liner and at least partially defining the combustion chamber, a compressed air passage fluidly coupling the combustion chamber to a source of compressed air, a first aperture extending through the combustor liner adjacent the dome assembly and fluidly coupling the compressed air passage to the combustion chamber, a second aperture extending through the combustor liner and axially spaced downstream from the first aperture along the combustor axis, and a fence wall located downstream of the second aperture and projecting radially, with respect to the combustor axis, into the combustion chamber from the combustor liner.

The combustor of any preceding clause, further comprising multiple apertures arranged circumferentially about the combustor liner with respect to the combustor axis, with the multiple apertures including at least one of the first aperture or the second aperture.

The combustor of any preceding clause, wherein the combustor defines a combustor length and the first aperture defines a first aperture distance, with the combustor length and the first aperture distance defined along the combustor axis with respect to the dome assembly, wherein the first aperture distance is between 0.01-0.2 times the combustor length.

The combustor of any preceding clause, wherein at least one of the first aperture or the second aperture comprises a circumferentially-extending slot having a variable aperture width.

The combustor of any preceding clause, further comprising an additional fence wall projecting radially into the combustion chamber from the combustor liner.

The combustor of any preceding clause, wherein the additional fence wall is positioned upstream of the fence wall and downstream of the first aperture.

The combustor of any preceding clause, wherein the additional fence wall comprises a first height and the fence wall comprises a second height greater than the first height.

The combustor of any preceding clause, wherein at least one of the fence wall or the additional fence wall comprises multiple discrete walls arranged circumferentially about the combustor liner with respect to the combustor axis.

The combustor of any preceding clause, wherein the combustor defines a combustor length with respect to the dome assembly, and the additional fence wall defines a first length from the dome assembly, wherein the first length is between 0.01-0.2 times the combustor length.

The combustor of any preceding clause, wherein the fence wall defines a second length from the additional fence wall, and wherein the second length is between 0.1-0.6 times the combustor length.

The combustor of any preceding clause, wherein the fence wall comprises a continuous fence wall extending circumferentially about the combustor liner with respect to the combustor axis.

The combustor of any preceding clause, further comprising a third aperture extending through the combustor liner, a first fence wall, a second fence wall, and a third fence wall.

The combustor of any preceding clause, wherein the second fence wall is the fence wall.

The combustor of any preceding clause, wherein the first fence wall is the additional fence wall.

The combustor of any preceding clause, wherein the first fence wall comprises a first height and a fourth height, the second fence wall comprises a second height and a fifth height, and the third fence wall comprises a third height and a sixth height.

The combustor of any preceding clause, wherein a ratio of the first height to the fourth height is between 0.1-5.

The combustor of any preceding clause, wherein a ratio of the second height to the fifth height is between 0.1-5.

The combustor of any preceding clause, wherein a ratio of the third height to the sixth height is between 0.1-5.

The combustor of any preceding clause, wherein a ratio of the first height to a dome height is between 0.005-0.2.

The combustor of any preceding clause, wherein a ratio of the second height to the first height is between 0-15.

The combustor of any preceding clause, wherein a ratio of the fifth height to the fourth height is between 0-15.

The combustor of any preceding clause, wherein a ratio of the third height to the first height is between 0-15.

The combustor of any preceding clause, wherein a ratio of the sixth height to the first height is between 0-15.

The combustor of any preceding clause, further comprising a third aperture extending through the combustor liner, and a third fence wall downstream of the third aperture.

The combustor of any preceding clause, wherein the fence wall comprises a second height and a fifth height, and wherein the third fence wall comprises a third height and a sixth height.

The combustor of any preceding clause, wherein a ratio of the second height to the fifth height is between 0.1-5.

The combustor of any preceding clause, wherein a ratio of the third height to the sixth height is between 0.1-5.

The combustor of any preceding clause, wherein a ratio of the third height to the second height is 0-15.

The combustor of any preceding clause, wherein a ratio of the fifth height to the sixth height is 0-1.5.

The combustor of any preceding clause, further comprising a first jet flow through the first aperture, a second jet flow through the second aperture, and a third jet flow through the third aperture.

The combustor of any preceding clause, wherein the first jet flow is greater than the second jet flow.

The combustor of any preceding clause, wherein the first jet flow is greater than the third jet flow.

The combustor of any preceding clause, wherein the first jet flow comprises between 1-20% of a total dilution flow through the set of dilution holes.

The combustor of any preceding clause, wherein the third jet flow comprises between 0-40% of the total dilution flow through the set of dilution holes.

The combustor of any preceding clause, wherein the second jet flow comprises 80-100% of the total dilution flow through the set of dilution holes.

What is claimed is:

1. A turbine engine, comprising:

a compressor section, a combustion section, and a turbine section in serial flow arrangement, and the combustion section having a combustor defining a combustor axis and comprising:

a combustor liner at least partially comprising a combustion chamber, the combustor liner defining an outer liner and an inner liner;

a dome assembly coupled to the combustor liner and at least partially defining the combustion chamber;

a compressed air passage fluidly coupling the compressor section to the combustion chamber;

a first aperture extending through the combustor liner adjacent the dome assembly and fluidly coupling the compressed air passage to the combustion chamber;

a second aperture extending through the combustor liner and axially spaced downstream from the first aperture along the combustor axis;

a fence wall located downstream of the second aperture and projecting radially, with respect to the combustor axis, into the combustion chamber from the outer liner; and an additional fence wall located downstream of the second aperture and projecting radially, with respect to the combustor axis, into the combustion chamber from the inner liner, the fence wall and the additional fence wall axially aligned along the combustor axis;

wherein each of the fence wall and the additional fence wall is configured to direct a fluid flow from at least one of the first aperture or the second aperture toward the center of the combustor to keep a combustion flame away from the combustor liner.

2. The turbine engine of claim 1, further comprising multiple apertures arranged circumferentially about the combustor liner with respect to the combustor axis, with the multiple apertures including at least one of the first aperture or the second aperture.

3. The turbine engine of claim 1, wherein at least one of the first aperture or the second aperture comprises a circumferentially-extending slot.

4. The turbine engine of claim 1, wherein the combustor defines a combustor length and the first aperture defines a first aperture distance, with the combustor length and the first aperture distance defined along the combustor axis with respect to the dome assembly, wherein the first aperture distance is between 0.01-0.2 times the combustor length.

5. The turbine engine of claim 1, wherein the additional fence wall comprises a first height and the fence wall comprises a second height greater than the first height.

6. The turbine engine of claim 1, wherein at least one of the fence wall or the additional fence wall comprises multiple discrete walls arranged circumferentially about the combustor liner with respect to the combustor axis.

7. The turbine engine of claim 1, wherein the fence wall comprises a continuous fence wall extending circumferentially about the combustor liner with respect to the combustor axis.

8. The turbine engine of claim 1, further comprising a third aperture downstream of the second aperture and a third fence wall projecting radially into the combustion chamber downstream of the third aperture.

9. The turbine engine of claim 8, wherein the second aperture comprises a circumferentially-arranged set of discrete apertures, and wherein the fence wall comprises a circumferentially-arranged set of discrete walls, with each discrete wall in the circumferentially-arranged set of discrete walls positioned downstream of each corresponding discrete aperture in the circumferentially-arranged set of discrete apertures.

10. The turbine engine of claim 1, wherein the first aperture is axially downstream from a dome shape of the dome assembly.

11. The turbine engine of claim 1, wherein the first aperture and the second aperture each define openings normal to the combustor axis.

12. A combustor for a turbine engine, comprising:

a combustor liner at least partially defining a combustion chamber along a combustor axis, the combustor liner comprising an outer liner and an inner liner;

a dome assembly coupled to the combustor liner and at least partially defining the combustion chamber;

a compressed air passage fluidly coupling the combustion chamber to a source of compressed air;

a first aperture extending through the combustor liner adjacent the dome assembly and fluidly coupling the compressed air passage to the combustion chamber;

a second aperture extending through the combustor liner and axially spaced downstream from the first aperture along the combustor axis;

a first fence wall located downstream of the second aperture and projecting radially, with respect to the combustor axis, into the combustion chamber from the outer liner; and a second fence wall located downstream of the second aperture and projecting radially, with respect to the combustor axis, into the combustion chamber from the inner liner;

wherein the first fence wall and the second fence wall are axially aligned along the combustor axis, and wherein each of the first fence wall and the second fence wall is configured to direct a fluid flow from at least one of the first aperture or the second aperture toward the center of the combustor to keep a combustion flame away from the combustor liner.

13. The combustor of claim 12, further comprising multiple apertures arranged circumferentially about the combustor liner with respect to the combustor axis, with the multiple apertures including at least one of the first aperture or the second aperture.

14. The combustor of claim 12, wherein the combustor defines a combustor length and the first aperture defines a first aperture distance, with the combustor length and the first aperture distance defined along the combustor axis with respect to the dome assembly, wherein the first aperture distance is between 0.01-0.2 times the combustor length.

15. The combustor of claim 12, further comprising an additional fence wall projecting radially into the combustion chamber from the combustor liner.

16. The combustor of claim 15, wherein the additional fence wall is positioned upstream of the first fence wall and downstream of the first aperture.

17. The combustor of claim 15, wherein the additional fence wall comprises a first height and the first fence wall comprises a second height greater than the first height.

18. The combustor of claim 15, wherein at least one of the first fence wall or the additional fence wall comprises multiple discrete walls arranged circumferentially about the combustor liner with respect to the combustor axis.

19. The combustor of claim 12, wherein the first fence wall comprises a continuous fence wall extending circumferentially about the combustor liner with respect to the combustor axis.

20. The combustor of claim 12, wherein the first fence wall and the second fence wall are axially aligned such that they at least partially overlap along the combustor axis.

* * * * *